US007328792B1

(12) United States Patent
Benson

(10) Patent No.: US 7,328,792 B1
(45) Date of Patent: Feb. 12, 2008

(54) TOILET PLUNGER CABINET SYSTEM

(76) Inventor: Mary J. Benson, 2600 A. E. Seltice Way, PMB 256, Post Falls, ID (US) 83854

( * ) Notice: Subject to any disclaimer, the term of this patent is extended or adjusted under 35 U.S.C. 154(b) by 446 days.

(21) Appl. No.: 10/733,461

(22) Filed: May 24, 2004

Related U.S. Application Data

(63) Continuation-in-part of application No. 10/210,996, filed on Jul. 31, 2002, now abandoned.

(60) Provisional application No. 60/386,848, filed on Jun. 6, 2002.

(51) Int. Cl.
*A47B 81/02* (2006.01)
*A47K 17/00* (2006.01)

(52) U.S. Cl. ..... 206/349; 206/364; 4/255.11

(58) Field of Classification Search ..... 206/349, 206/15.2, 361; D6/551; 4/255.11, 255.05; 312/206, 207
See application file for complete search history.

(56) References Cited

U.S. PATENT DOCUMENTS

| | | | | |
|---|---|---|---|---|
| 4,008,933 | A | 2/1977 | Wanek | 312/206 |
| 4,192,561 | A * | 3/1980 | Gunn | 312/42 |
| 4,211,750 | A * | 7/1980 | Gillespie | 422/123 |
| 4,273,392 | A * | 6/1981 | Stinson | 312/42 |
| 4,432,451 | A | 2/1984 | Hooser | 206/216 |
| 5,456,356 | A * | 10/1995 | Kurzawa | 206/349 |
| D374,584 | S | 10/1996 | Freeman | D6/519 |
| D393,169 | S | 4/1998 | Cross et al. | D6/551 |
| D403,906 | S | 1/1999 | Gotti | D6/524 |
| 5,927,492 | A * | 7/1999 | Moore | 206/349 |
| D414,064 | S | 9/1999 | Shafik | D6/525 |
| 5,984,100 | A | 11/1999 | Ramsey et al. | 206/581 |
| 6,038,709 | A * | 3/2000 | Kent | 4/255.05 |
| 6,050,401 | A * | 4/2000 | Michaelson | 206/225 |
| D425,744 | S | 5/2000 | McGuire | D6/551 |
| 6,109,429 | A | 8/2000 | Cunningham et al. | 206/15.2 |
| 6,193,059 | B1 | 2/2001 | Massaro | 206/225 |
| 6,241,091 | B1 * | 6/2001 | Moore et al. | 206/349 |
| 6,267,461 | B1 * | 7/2001 | Dunagan et al. | 312/49 |
| D458,068 | S * | 6/2002 | Hillman | D6/551 |
| 6,719,134 | B2 * | 4/2004 | Phillips et al. | 206/349 |
| 6,957,791 | B2 * | 10/2005 | Ellis | 242/560.2 |
| 2003/0173243 | A1 * | 9/2003 | Polito | 206/361 |

OTHER PUBLICATIONS

Derwent ACC-No. 2003-619649, Carrying case for recreational kite has integral spool, 2003.*

* cited by examiner

*Primary Examiner*—David T. Fidei

(57) ABSTRACT

A toilet plunger cabinet system for conveniently storing and transporting a plunger in a hygienic and aesthetically pleasing manner. The toilet plunger cabinet system includes a base for receiving a lower segment of a plunger and a cover removably connected to the base. The base has a lower plate with an extended portion extending upwardly from an upper surface thereof defining an upper opening. A support portion extends upwardly from the upper surface of the lower plate thereby allowing liquids to be removed from the inner portion of the suction cup of the plunger. The cover preferable includes a handle member for grasping by the user, wherein the cover removably fits about the extended portion. A strap member or a transporting handle may be attached to the base for allowing convenient transportation.

7 Claims, 9 Drawing Sheets

TOILET PLUNGER CABINET SYSTEM

CROSS REFERENCE TO RELATED APPLICATIONS

I hereby claim benefit under Title 35, United States Code, Section 120 of U.S. patent application Ser. No. 10/210,996 filed Jul. 31, 2002. This application is a continuation-in-part of the Ser. No. 10/210,996 application. The Ser. No. 10/210,996 application is currently ABANDONED. The Ser. No. 10/210,996 application is hereby incorporated by reference into this application. I also hereby claim benefit under Title 35, United States Code, Section 119(e) of U.S. provisional patent application Ser. No. 60/386,848 filed Jun. 6, 2002.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to toilet plunger accessories and more specifically it relates to a toilet plunger cabinet system for conveniently storing and transporting a plunger in a hygienic and aesthetically pleasing manner.

2. Description of the Related Art

Plunger cabinets have been in use for years. Examples of patented devices which may be related to the present invention include U.S. Pat. No. 4,008,933 to Wanek; U.S. Pat. No. 393,169 to Cross et al.; U.S. Pat. No. 374,584 to Freeman; U.S. Pat. No. 4,432,451 to Hooser; U.S. Pat. No. 5,984,100 to Ramsey et al.; U.S. Pat. No. 403,906 to Gotti; U.S. Pat. No. 6,109,429 to Cunningham et al.; U.S. Pat. No. 6,193,059 to Massaro; U.S. Pat. No. 425,744 to McGuire; U.S. Pat. No. 414,064 to Shafik.

While these devices may be suitable for the particular purpose to which they address, they are not as suitable for conveniently storing and transporting a plunger in a hygienic and aesthetically pleasing manner. Conventional toilet plunger storage devices do not provide a convenient plunger transportation system that is also hygienic.

In these respects, the toilet plunger cabinet system according to the present invention substantially departs from the conventional concepts and designs of the prior art, and in so doing provides an apparatus primarily developed for the purpose of conveniently storing and transporting a plunger in a hygienic and aesthetically pleasing manner.

BRIEF SUMMARY OF THE INVENTION

In view of the foregoing disadvantages inherent in the known types of toilet plunger accessories now present in the prior art, the present invention provides a new toilet plunger cabinet system construction wherein the same can be utilized for conveniently storing and transporting a plunger in a hygienic and aesthetically pleasing manner.

The general purpose of the present invention, which will be described subsequently in greater detail, is to provide a new toilet plunger cabinet system that has many of the advantages of the plunger covers mentioned heretofore and many novel features that result in a new toilet plunger cabinet system which is not anticipated, rendered obvious, suggested, or even implied by any of the prior art plunger enclosures, either alone or in any combination thereof.

To attain this, the present invention generally comprises a base for receiving a lower segment of a plunger and a cover which may or may not be removably connected to the base. The base has a lower plate with an extended portion extending upwardly from an upper surface thereof defining an upper opening. A support portion extends upwardly from the upper surface of the lower plate thereby allowing liquids to be removed from the inner portion of the suction cup of the plunger. The base preferably includes a handle member for grasping by the user, wherein the cover removably fits about the extended portion. A strap member or a transporting handle may be attached to the base for allowing convenient transportation.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toilet plunger cabinet system that will overcome the shortcomings of the prior art devices.

A second object is to provide a toilet plunger cabinet system for conveniently storing and transporting a plunger in a hygienic and aesthetically pleasing manner.

Another object is to provide a toilet plunger cabinet system that is capable of receiving and storing toilet plungers, brushes, toilet paper and other bathroom related items.

An additional object is to provide a toilet plunger cabinet system that provides convenient access to a plunger being stored.

A further object is to provide a toilet plunger cabinet system that is convenient and easy to transport a plunger within.

A further object is to provide a toilet plunger cabinet system that promotes a hygienic bathroom environment that prevents the transmission of disease and germs.

Another object is to provide a toilet plunger cabinet system that receives various sizes and shapes of toilet plungers.

A further object is to provide a toilet plunger cabinet system that is positionable within various locations of a bathroom.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
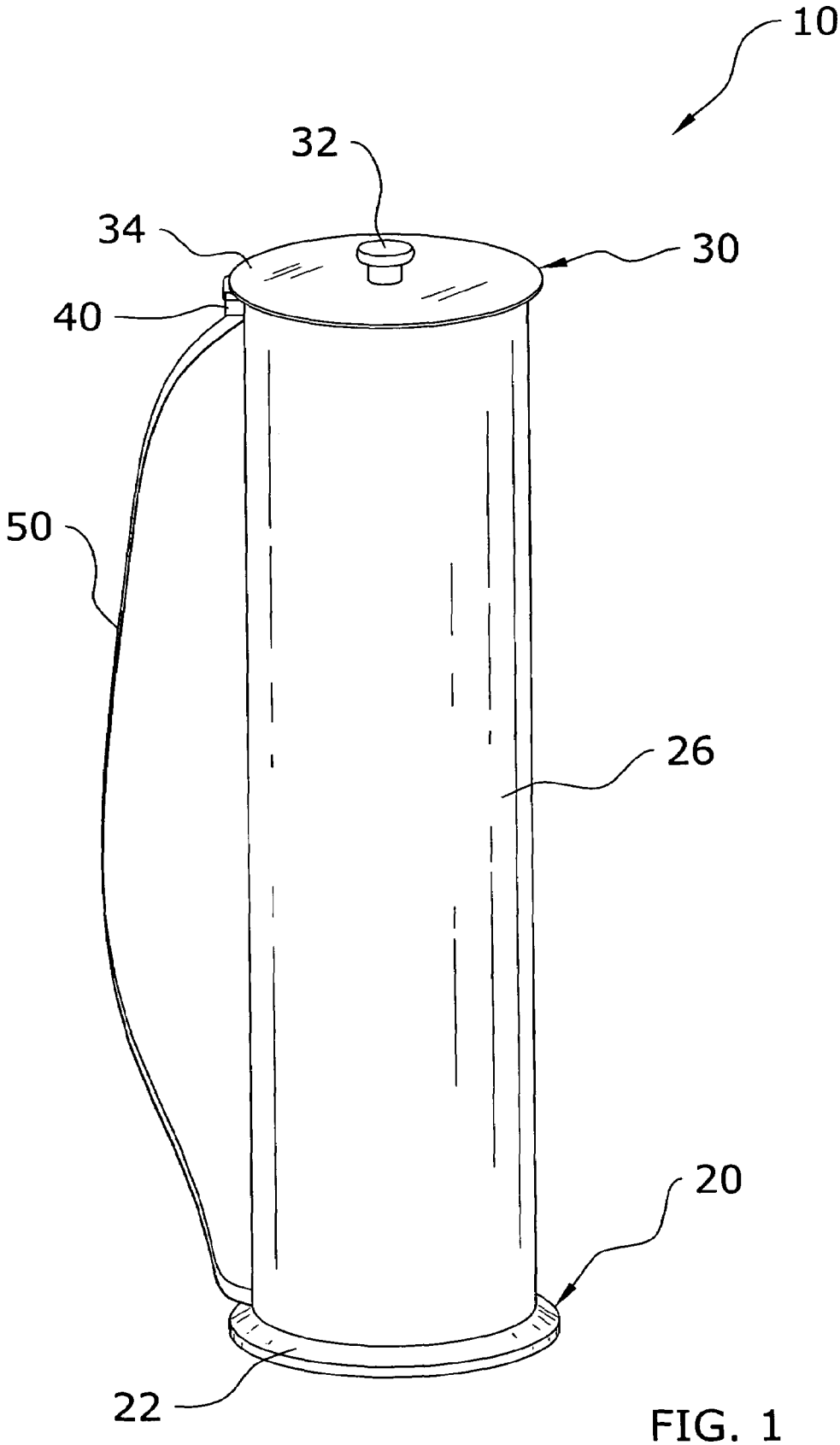
FIG. 1 is an upper perspective view of the present invention.

Turning now descriptively to the drawings, in which similar reference characters denote similar elements throughout the several views, FIGS. 1 through 9 illustrate a toilet plunger cabinet system 10, which comprises a base 20 for receiving a lower segment of a plunger 12 and a cover 30 removably connected to the base 20. The base 20 has a lower plate 22 with an extended portion 26 extending upwardly from an upper surface thereof defining an upper opening 27. A support portion 24 extends upwardly from the upper surface of the lower plate 22 thereby allowing liquids to be removed from the inner portion of the suction cup 16 of the plunger 12. The cover 30 preferable includes a handle member 32 for grasping by the user, wherein the cover 30 removably fits about the extended portion 26. The base 20 and cover 30 may be comprised of various well-known materials including but not limited to plastic, metal and wood. A strap member 50 or a transporting handle 52 may be attached to the base for allowing convenient transportation.

Figure 2:
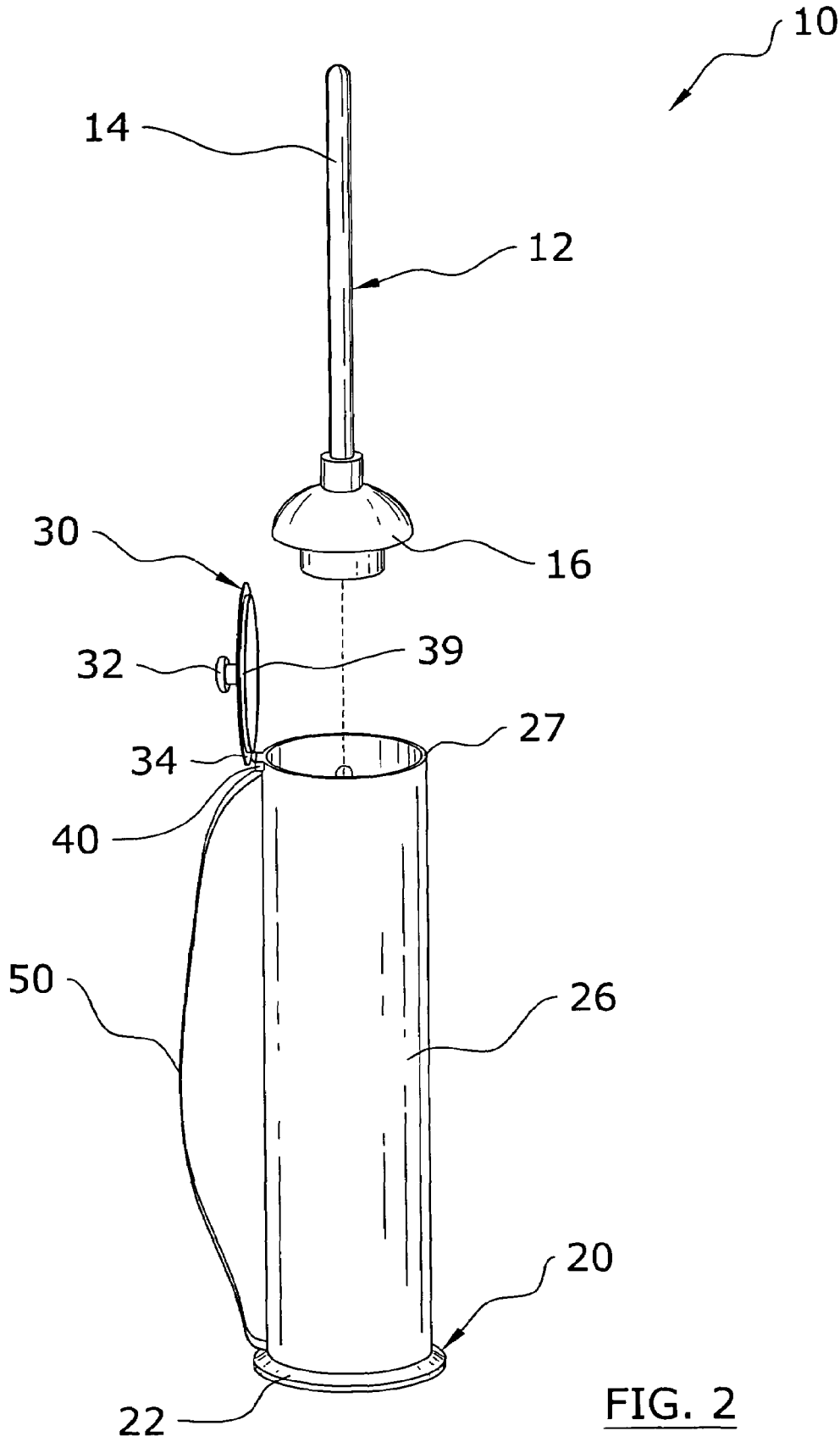
FIG. 2 is an exploded upper perspective view of the present invention with a plunger.
Figure 4:
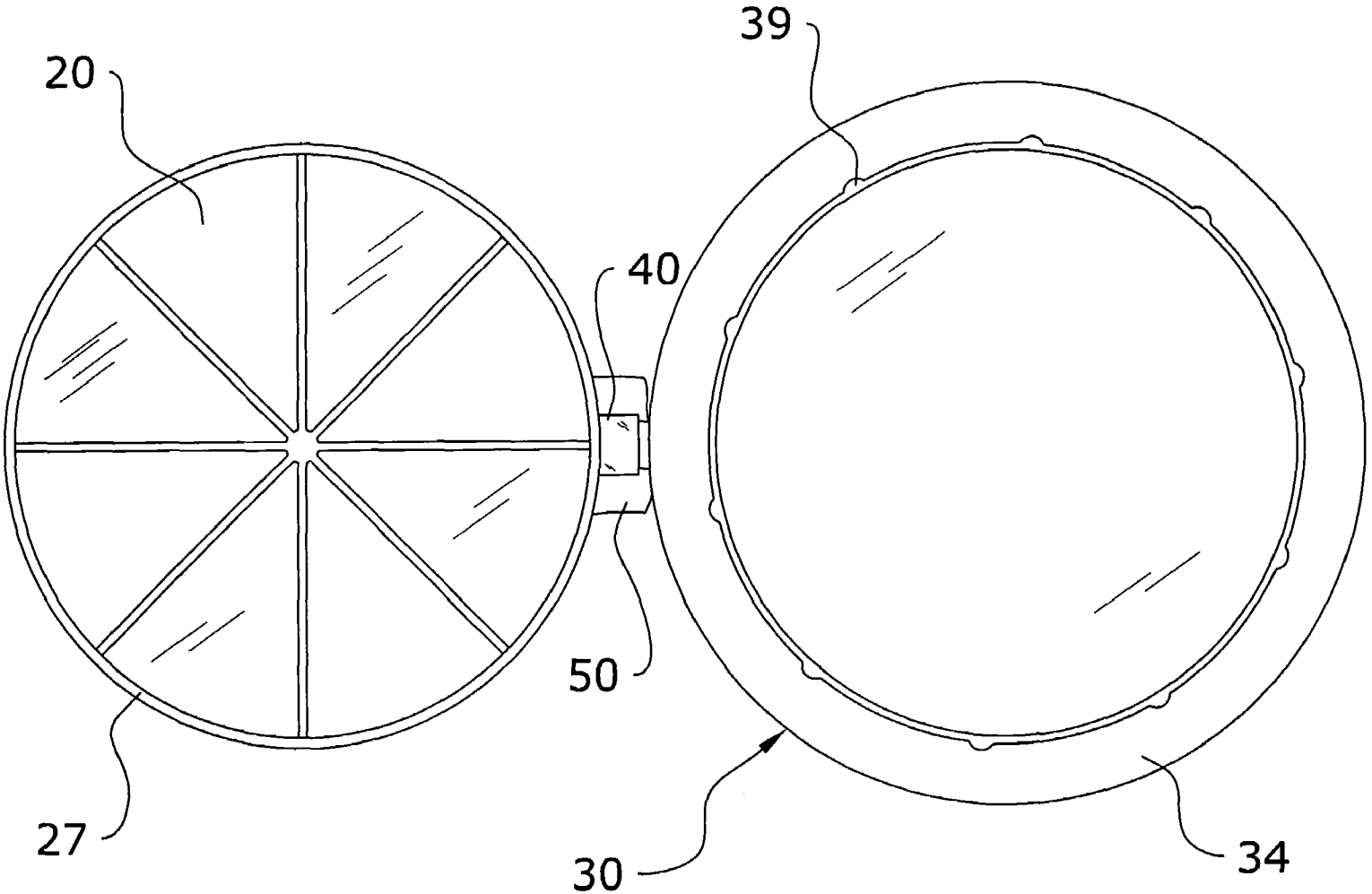
FIG. 4 is a top view of the base.

As shown in FIGS. 2 and 4 of the drawings, the base 20 includes a lower plate 22 and an extended portion 26 that extends upwardly from an upper surface of the base 20. The lower plate 22 may have various shapes and structures including but not limited to a flat circular structure as shown in FIGS. 2 and 4 of the drawings.

The extended portion 26 extends a finite distance (preferably less than 3 inches) upwardly forming an interior cavity within the base 20 that receives either all or a portion of the suction cup 16 of the plunger 12. The extended portion 26 preferably has an outer perimeter shape and size sufficient to allow removable positioning of the cover 30 upon as best illustrate in FIGS. 2 and 3 of the drawings. The extended portion 26 preferably has a shape similar to the shape of the cover 30 with the outer perimeter slightly smaller than the inner perimeter of the cover 30.

The base 20 further preferably includes a support portion 24 extending upwardly from the upper surface of the lower plate 22 for supporting the suction cup 16 of the plunger 12 upwardly from the upper surface for allowing drainage of water from the interior of the suction cup 16. The support portion 24 preferably is comprised of a raised X-shaped structure as best illustrated in FIG. 4 of the drawings. However, the support portion 24 may have various other shapes and structures to elevate the suction cup 16 from the upper surface of the lower plate 22.

Figure 3:
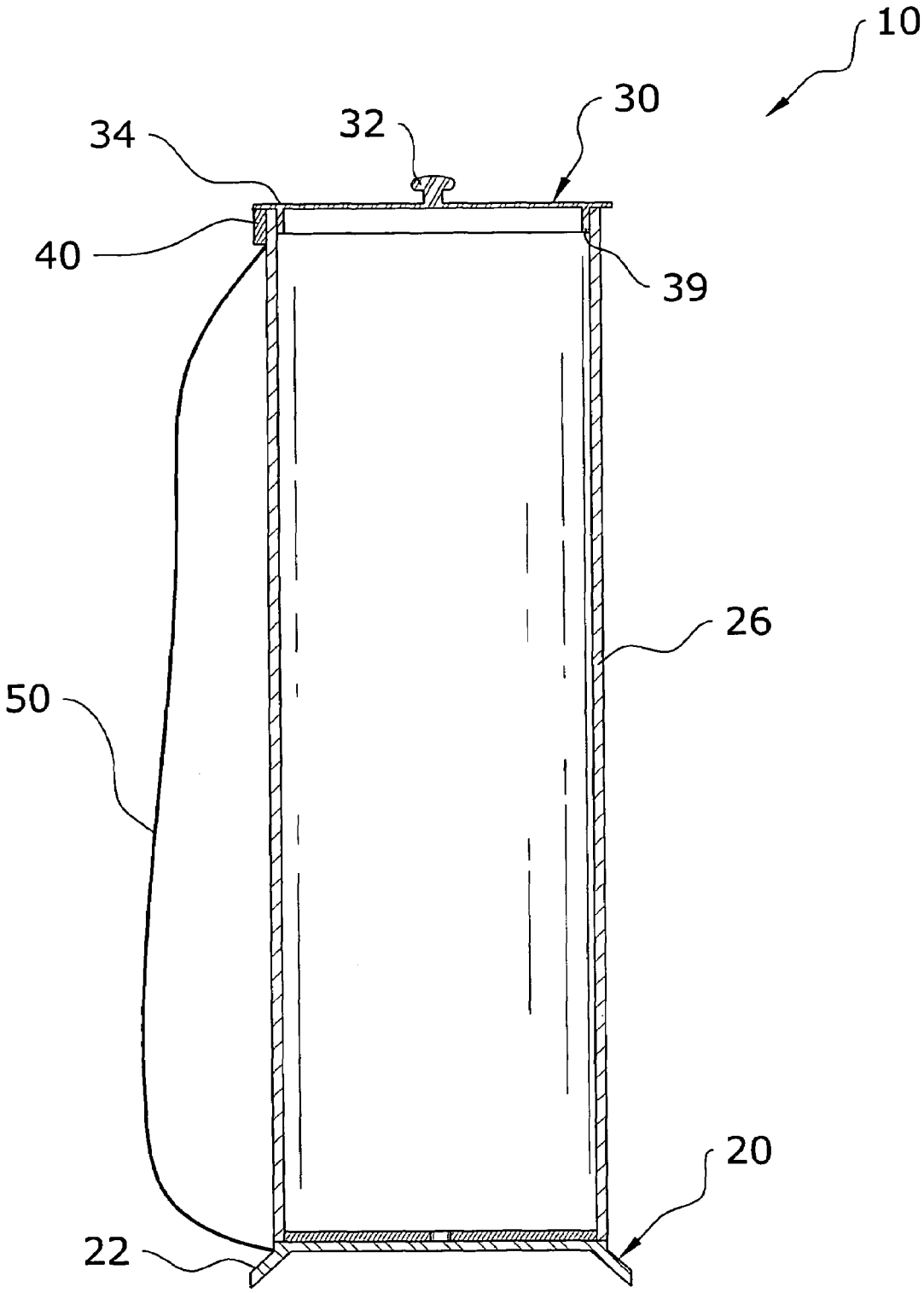
FIG. 3 is a cross sectional view taken along line 3-3 of FIG. 1.

As shown in FIGS. 1 through 3 of the drawings, the cover 30 preferably has an elongate tubular structure with a lower end 36, an upper end 34 and a body portion 38. The cover 30 preferably has a length sufficient to enclose the plunger 12 including the suction cup 16 and the elongate handle 14. The cover 30 may have various cross sectional shapes such as but not limited to circular, square, rectangular and oval. The upper end 34 of the cover 30 is preferably enclosed, however various other structures may be used to construct the upper end 34 including partially open structures.

A handle member 32 is preferably attached to the upper end 34 of the cover 30 as best illustrated in FIGS. 1 through 3 of the drawings. The handle member 32 preferably has a spherical shape, however various other shapes may also be utilized to construct the handle member 32. To remove the cover 30 from the base 20 to provide access to the plunger 12, the user simply grasps the handle member 32 and then elevates the cover 30 from the base 20 thereby exposing the plunger 12.

Figure 5:
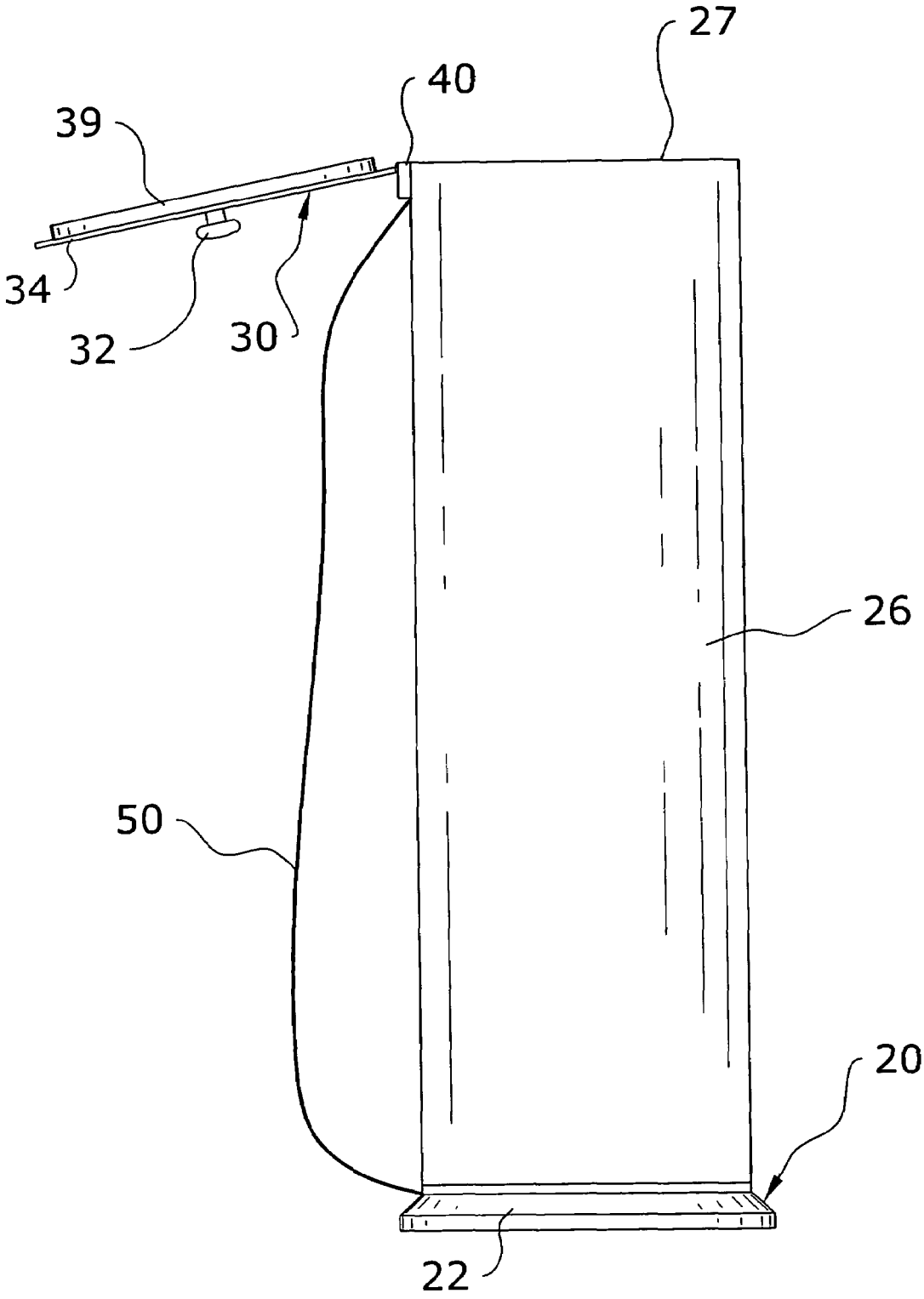
FIG. 5 is an upper perspective view of a first alternative embodiment.
Figure 6:
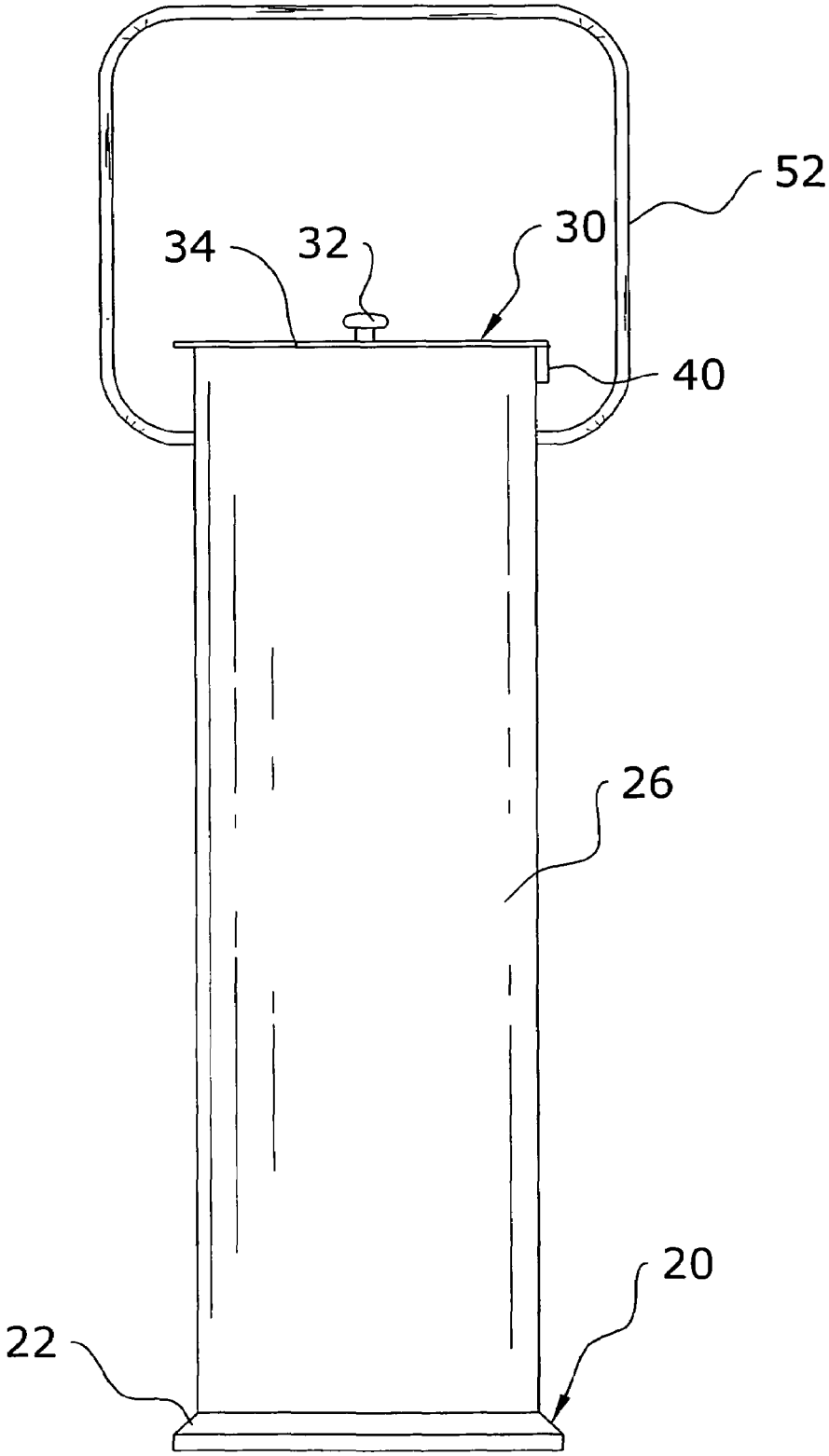
FIG. 6 is an exploded upper perspective view of the first alternative embodiment with a plunger.
Figure 7:
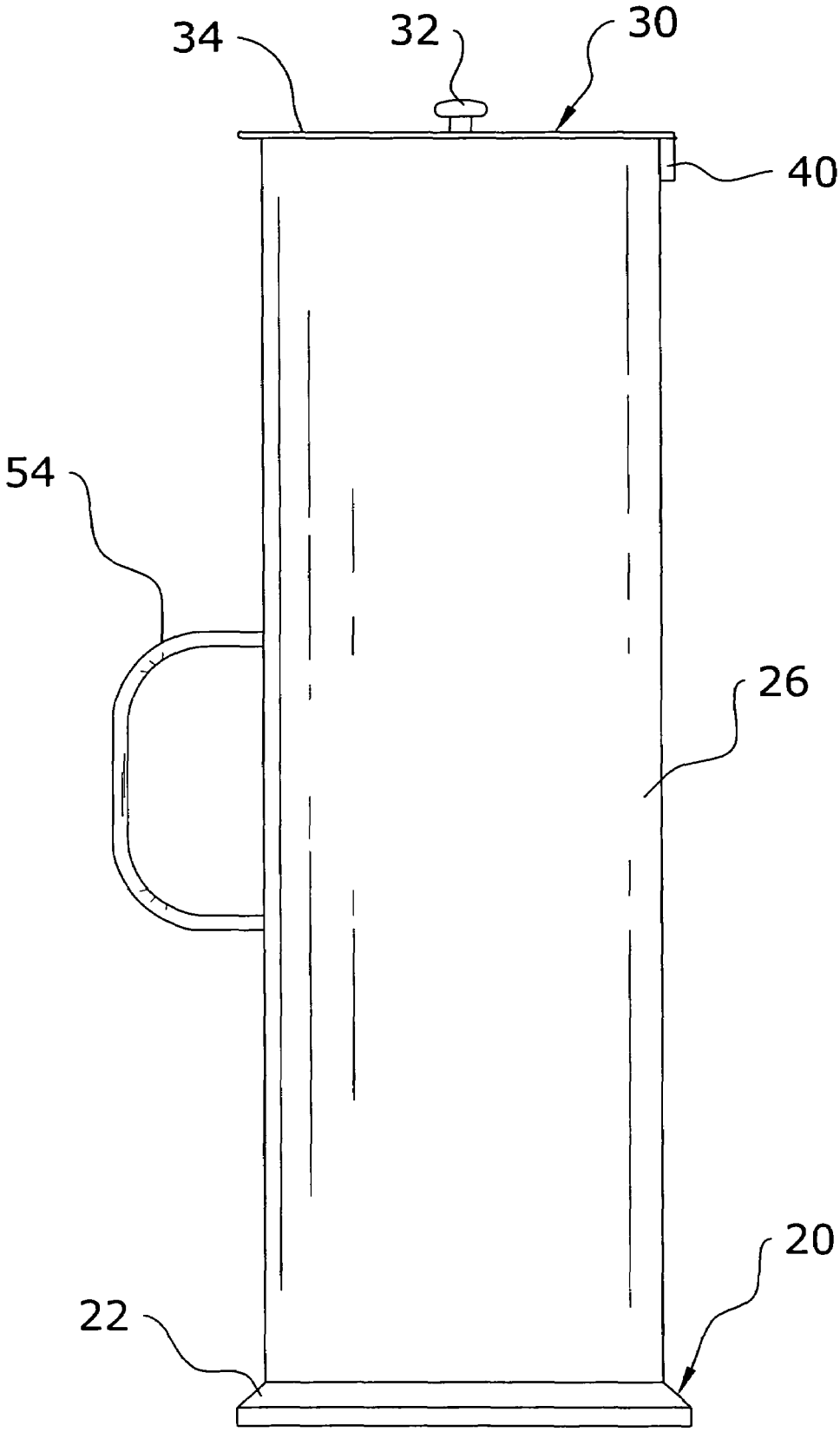
FIG. 7 is an upper perspective view of a second alternative embodiment illustrating the opening of the cover.

As shown in FIGS. 1, 2, 5, 6 and 7 of the drawings, a strap member 50 is preferably attached to the base 20. The strap member 50 is preferably attached to the upper portion and the lower portion of the extended portion 26 as best illustrated in FIGS. 1 and 7 of the drawings. The strap member 50 is preferably comprised of a flexible and strong material. The strap member 50 is preferably of sufficient length to allow for carrying about the shoulder of an individual, however the strap member 50 may be shorter in length wherein the individual may simply grasp the strap member 50.

Figure 8:
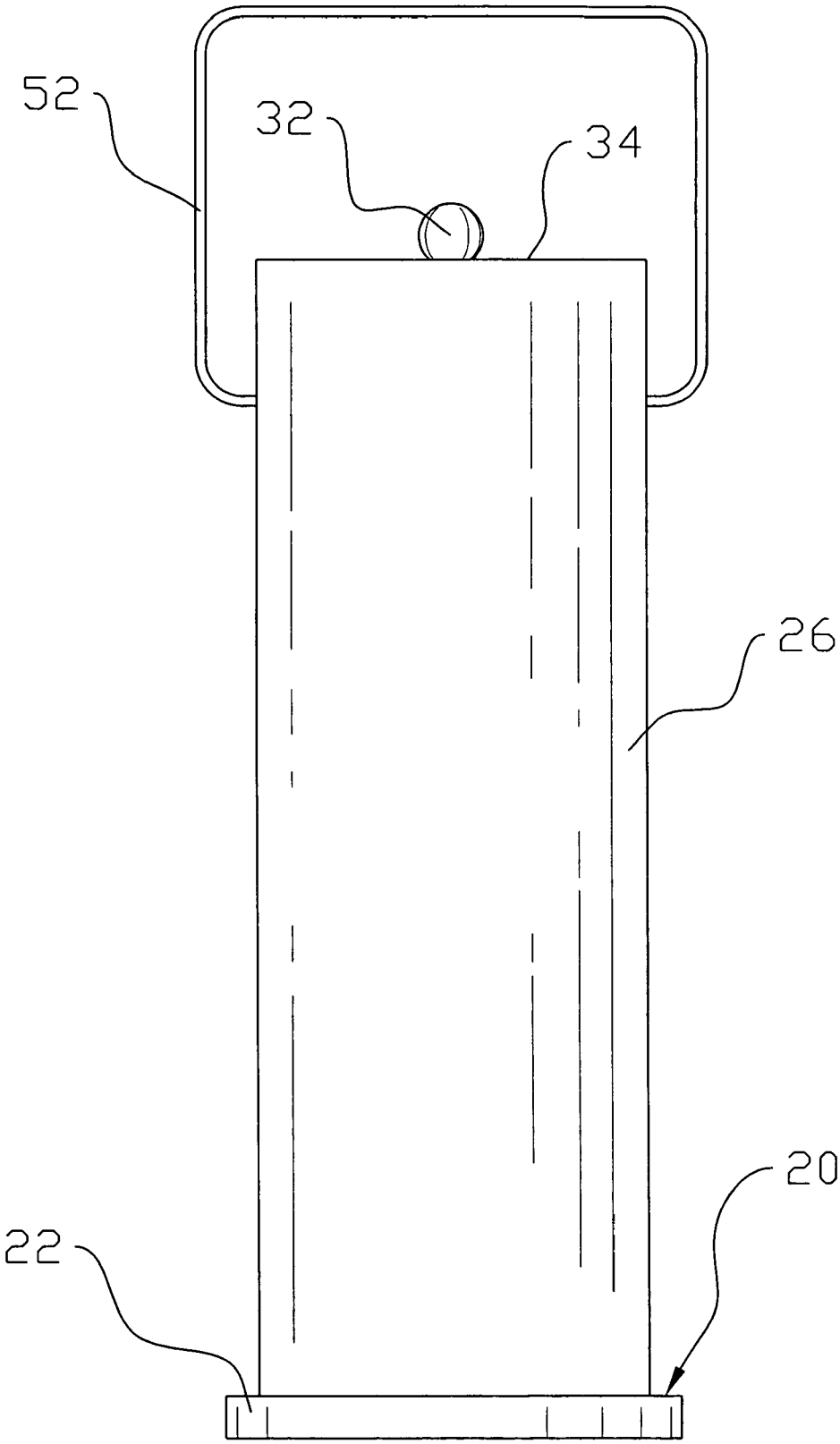
FIG. 8 is a side view of a third alternative embodiment illustrating a transporting handle attached to the upper portion of the present invention.
Figure 9:
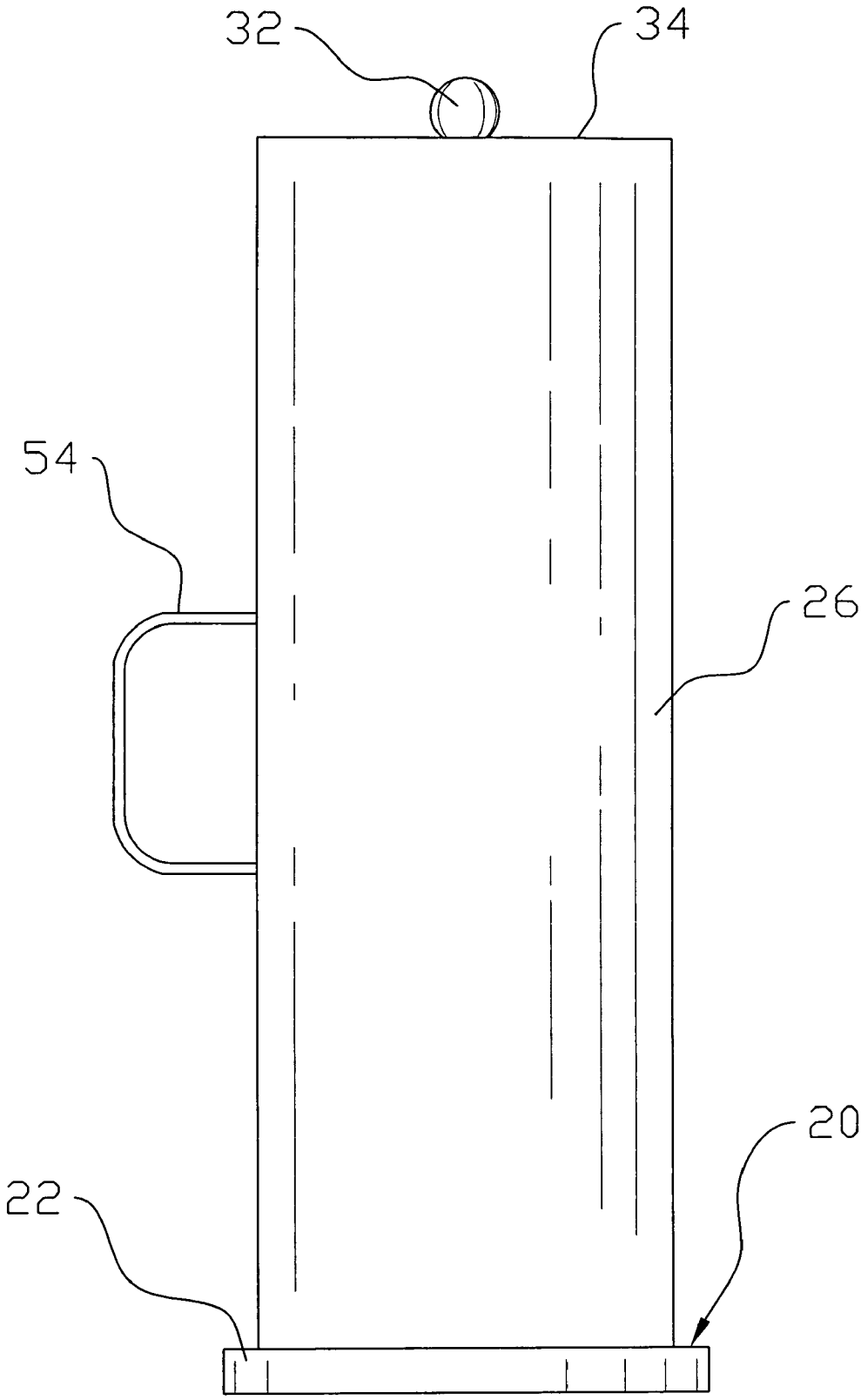
FIG. 9 is a side view of a third alternative embodiment illustrating a transporting handle attached to the side portion of the present invention.

FIGS. 8 and 9 illustrate the usage of a transporting handle 52 that has an inverted U-shaped structure. The transporting handle 52 may be comprised of a flexible or rigid structure. FIG. 8 illustrates attaching transporting handle 52 to the upper portion of the extended portion 26 in an upright manner. FIG. 9 illustrates attaching transporting handle 52 to the side portion of the extended portion 26 in a sideways manner.

The lower end 36 of the cover 30 is comprised of an opening that removably fits about the extended portion 26 of the base 20. The lower end 36 of the cover 30 preferably has size and shape sufficient to removably fit about the extended portion 26.

FIGS. 5 and 6 of the drawings illustrate a first alternative embodiment of the present invention. FIG. 6 illustrates that the first alternative embodiment has a vertically elongate base 20 wherein the extended portion 26 is extended significantly upwardly compared to the main embodiment of the present invention. The cover 30 preferably is comprised of an upper end 34 having a flat structure with a lower lip 39 extending downwardly from thereof that fits within the upper opening 27 of the base 20 as further show in FIG. 6 of the drawings. The cover 30 is simply removed to access the plunger 12 within the base 20. In a second alternative embodiment of the present invention illustrated in FIG. 7, the cover 30 is similar in structure to the first alternative embodiment except pivotally attached to the base 20 about the upper opening 27 by a hinge 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet plunger cabinet system for storing a plunger, comprising:

a base having a lower plate and an extended portion extending upwardly from an upper surface of said lower plate defining a lower cavity for receiving a suction cup of said plunger;

wherein said base includes a support portion within said upper surface of said lower plate;

wherein said support portion has an X-shaped structure;

wherein said extended portion has an elongate tubular structure with an upper opening;

wherein said lower plate has a flat structure;

a strap member attached to said base;

a cover removably attachable about said extended portion of said base;

a hinge pivotally connected between said cover and said extended portion for pivotally supporting said cover;

wherein said cover is comprised of an elongate tubular structure;

wherein said cover has an upper end, a body portion and an open lower end;

wherein said upper end is enclosed;

wherein said body portion has a circular cross section;

wherein said cover has a lower lip that fits within said upper opening of said extended portion of said base;

a handle member attached to said upper end of said cover;

wherein said handle member has a spherical shape; and a toilet plunger positioned within said base and completely surrounded by said base.

2. The toilet plunger cabinet system of claim 1, wherein said extended portion has a height less than 3 inches.

3. The toilet plunger cabinet system of claim 2, wherein said extended portion and said cover have a similar cross sectional shape.

4. The toilet plunger cabinet system of claim 1, wherein said cover is comprised of a flat structure.

5. A toilet plunger cabinet system for storing a plunger, comprising:

a base having a lower plate and an extended portion extending upwardly from an upper surface of said lower plate defining a lower cavity for receiving a suction cup of said plunger;

wherein said base includes a support portion within said upper surface of said lower plate;

wherein said support portion has an X-shaped structure;

wherein said extended portion has an elongate tubular structure with an upper opening;

wherein said lower plate has a flat structure;

a transporting handle having a U-shaped structure attached to said base;

a cover removably attachable about said extended portion of said base;

a hinge pivotally connected between said cover and said extended portion for pivotally supporting said cover;

wherein said cover is comprised of an elongate tubular structure;

wherein said cover has an upper end, a body portion and an open lower end;

wherein said upper end is enclosed;

wherein said body portion has a circular cross section;

wherein said cover has a lower lip that fits within said upper opening of said extended portion of said base;

a handle member attached to said upper end of said cover;

wherein said handle member has a spherical shape; and a toilet plunger positioned within said base and completely surrounded by said base.

6. The toilet plunger cabinet system of claim 5, wherein said transporting handle is attached on opposing sides of said base and is attached to an upper portion of said base.

7. The toilet plunger cabinet system of claim 5, wherein said transporting handle is attached to a central position of said base.

* * * * *